United States Patent [19]

Felici

[11] 4,137,578

[45] Feb. 6, 1979

[54] KITCHEN SCOOP AND PLUNGER

[76] Inventor: John D. Felici, 260 Geo. Waterman Rd., Apt. 302, Johnston, R.I. 20919

[21] Appl. No.: 730,766

[22] Filed: Oct. 8, 1976

[51] Int. Cl.[2] ..... A47J 43/28; A47L 17/00; B25F 1/00

[52] U.S. Cl. ..... 4/255; 15/105; 81/1 R

[58] Field of Search ..... 4/255–257; 222/386; 138/89; 15/104.3, 104.16; 417/472; 81/1 R; 30/130

[56] References Cited

U.S. PATENT DOCUMENTS

| | | | |
|---|---|---|---|
| 2,128,217 | 8/1938 | Anderson | 4/255 |
| 2,977,300 | 8/1961 | House | 4/255 X |
| 3,053,203 | 9/1962 | Gaddini | 30/130 X |
| 3,427,636 | 2/1969 | Seifert | 15/105 |
| 3,644,943 | 2/1972 | Leonardo et al. | 4/255 |
| 3,765,275 | 10/1973 | Johnson | 81/1 R |
| 3,783,457 | 1/1974 | Tornabene | 4/255 |
| 3,918,355 | 11/1975 | Weber | 222/386 X |
| 3,994,032 | 11/1976 | Spickofsky | 4/255 |
| 4,034,427 | 7/1977 | Breznock et al. | 4/255 |

FOREIGN PATENT DOCUMENTS

| | | | |
|---|---|---|---|
| 509487 | 10/1937 | United Kingdom | 50/130 |

*Primary Examiner*—Stuart S. Levy
*Attorney, Agent, or Firm*—Geoffrey R. Myers; William D. Hall

[57] ABSTRACT

A combination scoop and plunger for corralling refuse in a kitchen sink and forcing it through the drain opening into the garbage disposal area, comprising a single molded plastic scoop and bellows arrangement, having within its hollow portion a hollow plunger whose neck portion is removably connected to the upper portion of the bellows and which may be provided with cleanser that can be dispensed therefrom. When the bellows are collapsed, the bottom portion of the plunger contacts the refuse, forcing it through the drain opening.

6 Claims, 5 Drawing Figures

KITCHEN SCOOP AND PLUNGER

This invention relates to a kitchen utensil. More particularly, this invention relates to a kitchen utensil which may be employed to corral food or other refuse and force it through the drain opening in a kitchen sink above the garbage disposal unit.

It is a well-known problem in kitchen practices that where there is provided a drain opening above a garbage disposal unit, food and other refuse meant to be ground by the garbage disposal unit often clog the drain opening. In order to clear the clog, one must often employ his hand or a kitchen utensil to push the refuse through the drain opening and into the garbage disposal unit. Not only does this present a cleanliness problem, but it also presents a less-than-safe condition.

Several devices have been developed in the past for attacking at least one of the problems of corralling refuse in a sink, or plunging the refuse to clear a drain opening. Examples of such devices may be found in the following United States patents:

U.S. Pat. No. 2,128,217
U.S. Pat. No. 460,350
U.S. Pat. No. 382,129
U.S. Pat. No. 355,806
U.S. Pat. No. 283,205
U.S. Pat. No. 220,330
U.S. Pat. No. 3,823,427
U.S. Pat. No. 3,644,943
U.S. Pat. No. 3,952,341
U.S. Pat. No. 3,800,352
U.S. Pat. No. 2,020,293
U.S. Pat. No. 2,644,181

Such prior art techniques have not always been satisfactory, primarily due to one of several factors, such as ease of manufacturing, ultimate expense, complexity of the device, unsatisfactory operation, the inability to perform more than one function, and the like.

In view of the above, it can be readily seen that there exists a need for a kitchen utensil which overcomes the above problems and is versatile for its intended purpose. It is a purpose of this invention to fulfill this need in the art, as well as other needs which will become more apparent to the skilled artisan once given the following disclosure.

Generally speaking, this invention provides a kitchen utensil comprising in combination: a means for guiding refuse to a drain opening and a means for forcing the refuse into and through the drain opening; the means for guiding the refuse including a hollow guide portion defining a guide orifice the guide orifice having a guide orifice exit which is larger than the drain opening, and a hollow, collapsible, retractable bellows defining a bellows orifice which communicates with the guide orifice; the means for forcing refuse into and through the drain opening including a plunger the lower portion of which is of smaller diameter than the drain opening, the plunger being of sufficient length and so located within the guide means that the plunger is held above the guide orifice exit when the bellows is in its retracted condition and extends below the guide orifice exit when the bellows is in its collapsed condition.

In certain preferred embodiments, the plunger is substantially hollow, and may contain a cleaning liquid or powder for the sink. In such an event, the plunger neck, and means which retains it in the scoop device, may be provided with dispensing holes for dispensing the cleanser from the top of the device. In certain other embodiments, the device's parts may be made of unitary pieces of molded plastic, and, thus, simply formed with little expense.

This invention will now be described with respect to certain embodiments thereof in relation to accompanying illustrations wherein:

IN THE DRAWINGS

Figure 1:
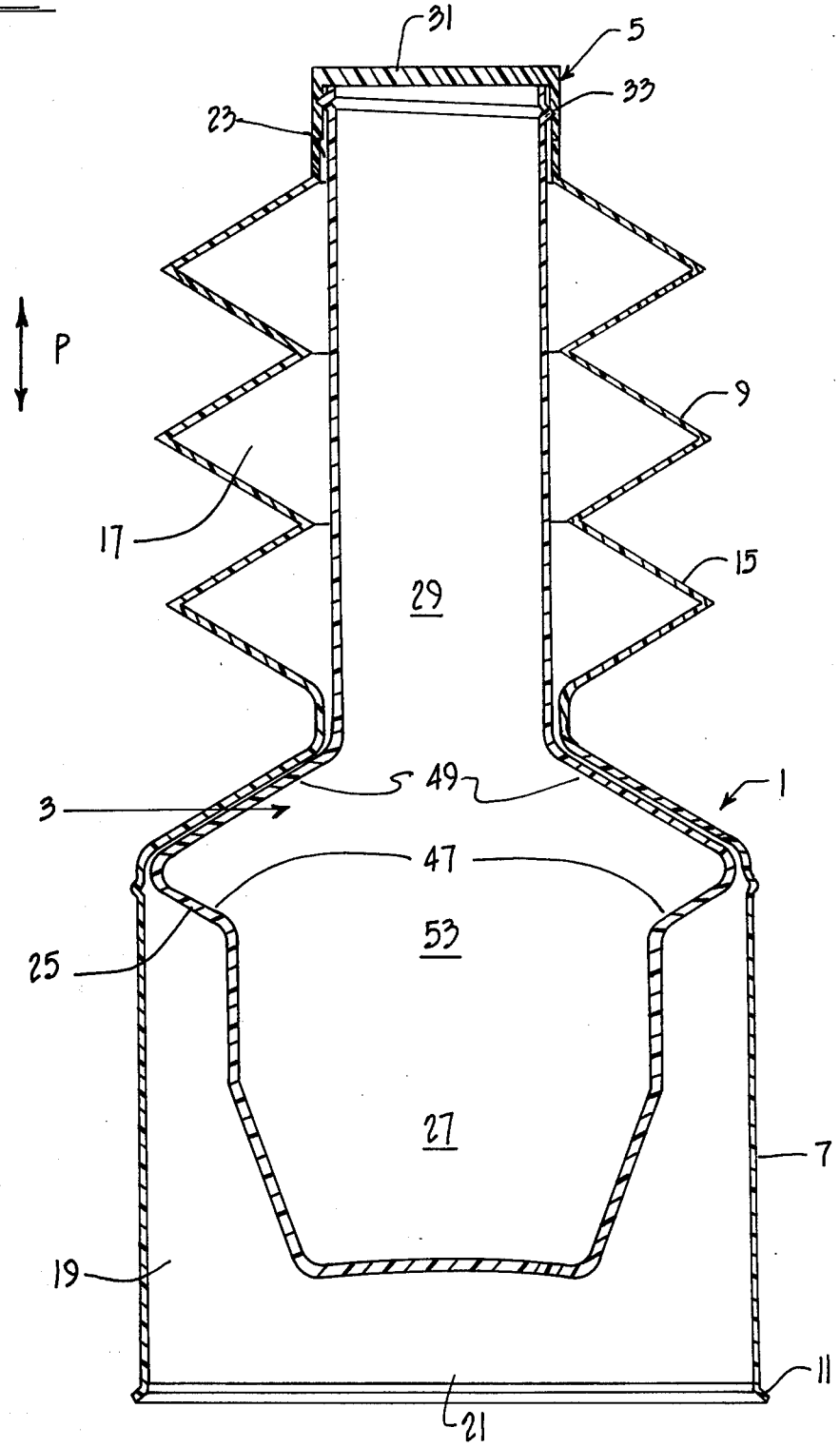
FIG. 1 is a side sectional view of an embodiment of this invention.

Referring to FIG. 1, it can be seen that the illustrated device is made of three basic unitary structures. The first structure 1 is a means for guiding refuse to a drain opening. The second structure 3 is a means for forcing refuse into and through the drain opening. The third structure 5 is a means for retaining means 3 within means 1.

Figure 4:
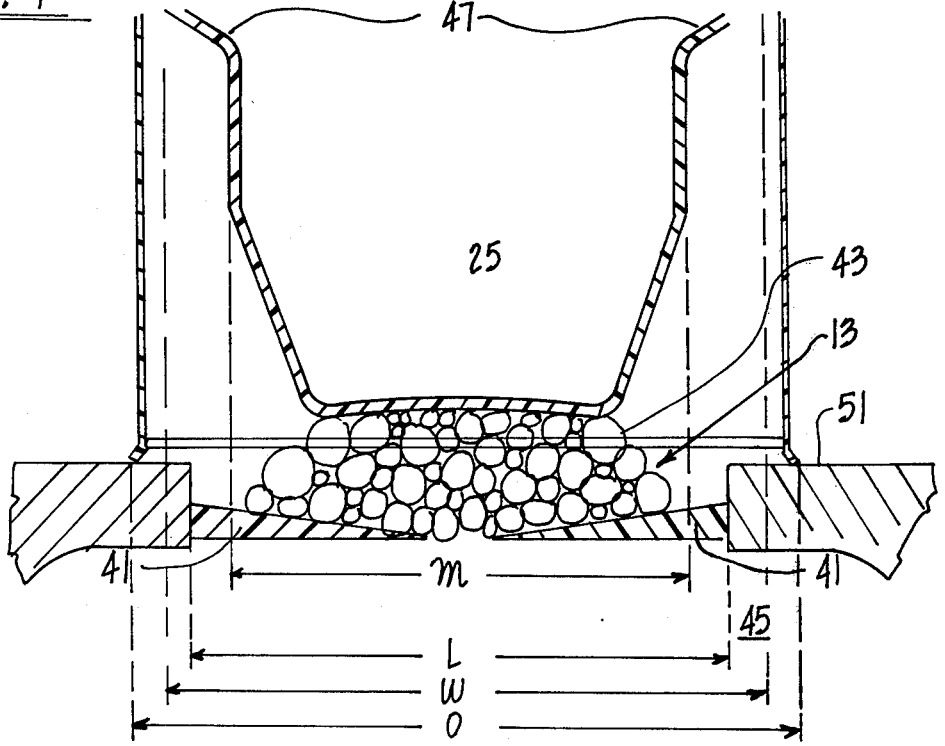
FIG. 4 is a side plan, partially sectionalized view of the embodiment of FIG. 1 employed over a typical drain orifice leading to a garbage disposal unit (not shown for convenience).

Means 1, used for guiding or corralling refuse to a drain opening, is comprised of a single-walled unit, defining a lower hollow guide portion 7, which, as can be seen with respect to FIG. 4, has a width "O" greater than the width "L" of drain opening 13. The upper portion of means 1 is comprised of bellows 9. Bellows 9 are constructed in accordance with conventional techniques, and are, in this respect, both collapsible and retractable by the employment of force in the direction of pressure arrows "P", as illustrated in FIG. 1. The lower surface of guide portion 7 may be provided with an outwardly flaring flange 11 so as to provide better scooping (corralling and guiding) action when employing the device to corral refuse and push it over a drain opening, such as shown in FIG. 4.

Generally speaking, walls 15 of means 1 are of uniform thickness throughout. The walls of the bellows configuration at 9 are of sufficient dimensions to provide retractability and collapsibility when of a substantial cross-sectional shape. Simultaneously, the walls should render guide portion 7 sufficiently rigid to act as a corral and allow the device to stand upright on its own. Exemplary of an appropriate thickness using molded polyethylene or polyproylene is about 1/16". As can be seen, the device is substantially hollow, and, thus, walls 15 define a bellows orifice (chamber) 17 and a guide orifice (chamber) 19. Orifices 17 and 19 are contiguous and communicate with one another, such that at the lower portion of guide orifice 19 there is formed orifice exit 21, while at the upper portion of bellows orifice 17, there is formed a bellows orifice exit 23.

Means 3 for forcing refuse through a drain opening 13 are located within bellows orifice 17 and guide orifice 19. In the embodiment illustrated, means 3 comprises a hollow plunger 25, preferably of a hollow blow-molded plastic configuration capable of retaining a liquid or powder (cleanser) cleaner useful for cleaning the sink. Plunger 25 includes a lower plunger portion 27 and an upper neck portion 29. Lower plunger portion 27 is located in guide orifice (chamber) 19, while upper neck portion 29 resides in bellows orifice (chamber) 17.

Figure 2:
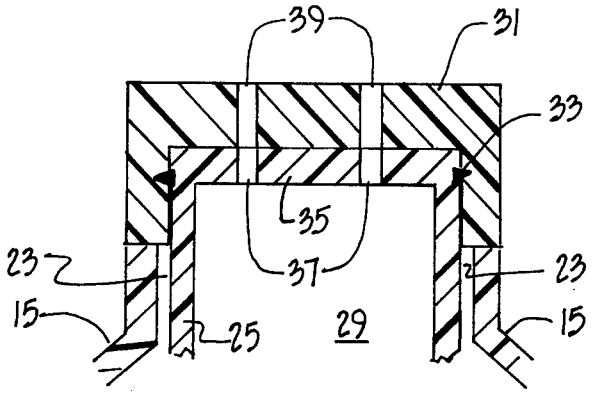
FIG. 2 is a partial plan side sectional view of the top of an embodiment of this invention, wherein there are provided dispensing holes.

Plunger 25 may be retained within means 1 by any suitable means. In those instances where it is desirable to be able to remove plunger 25 rapidly and/or to replace it, the retaining means 5 may preferably comprise a simple cap means 31, as shown in FIGS. 1 and 2. In this respect, cap 31 is retained in an overlapping position with walls 15 at bellows orifice exit 23 via snap flange 33 (as shown in FIG. 2) or screw thread flange 33' (as shown in FIG. 1). In this simple, inexpensive way, plunger 25 is effectively retained, but easily removed merely by snapping off cap 31.

Figure 3:
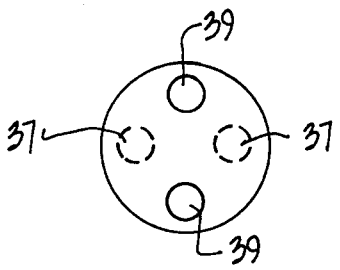
FIG. 3 is a top plan view of the cap of FIG. 2.

In the embodiment illustrated in FIG. 2, a similar construction is illustrated, as in FIG. 1, except for the provision therewithin, of a means for dispensing a liquid or solid from plunger 25. Such a dispensing means includes closing off the exit of upper neck portion 29 with a membrane 35 which is provided with a series (in this instance 2 or more) dispensing holes 37. Aligning holes 39 are then provided in cap 31 via snap flange 33; cap 31 may be rotated by twisting it on flange 33. As illustrated in FIG. 3, by twisting cap 31, holes 39 may be brought into alignment with dispensing holes 39, so as to communicate the hollow chamber 53 of plunger 25 with these holes for dispensing purposes; or, in the alternative, further rotating the cap to bring these holes into non-aligned formation, thereby sealing chamber 53.

The illustrated device is operated by grasping it in its upper portion, usually by placing the hand over cap 31 and a portion of bellows 9. Refuse in a sink is then corralled over drain 13, using as a scoop flange portion 11. The refuse usually lodges on flexible rubber or plastic drain flaps 41. It is now desirable that this refuse 43 be pushed past flaps 41 and downwardly into the garbage disposal chamber 45. This is accomplished by pushing downwardly with the hand in the direction of the downwardly arrow P, thereby collapsing bellows 9, which, in turn, forces plunger 25 to engage refuse 43 and push it past flaps 41 into chamber 45. In this respect, the lower portion 27 of plunger 25 is provided with a dimension "M" smaller than and readily insertable through drain opening 13. On the other hand, the upper portion of portion 27 is provided with an outwardly flaring flange 47, whose ultimate diameter "W" is larger than the width "L" of drain opening 13, thereby to act as a stop mechanism, so that the plunger 25 may not be inserted downwardly so far as to interfere with the grinding operation taking place. Lower plunger portion 27 is then further provided with an inwardly and upwardly flaring flange 49, which connects lower portion 27 to neck portion 29 and which provides an upward stop mechanism, so that upon releasing pressure and retracting bellows 9, either by way of automatic flexibility built into the bellows or by pulling up on the bellows in the direction of the upward arrow "P", plunger 25 is not pulled from the utensil.

In those embodiments wherein plunger 25 is a hollow bottle containing a cleansing powder or the like, cap 31 would have been initially rotated during the corralling and plunging operation, so that dispensing holes 37 were non-aligned with holes 39, thereby to keep the cleansing material sealed within hollow chamber 53 of plunger 25. After the corralling and plunging operation, it then might become desirable to clean the sink surface 51. This is accomplished by aligning holes 37 with holes 39, as above described, via rotation of cap 31 about snap flange 33, tipping over the utensil and shaking it to sprinkle the cleansing powder onto surface 51. During this operation, inwardly flaring flange 49 prevents the bottle 25 from falling from means 1. If desired, in combination with the utensil, there can be provided on a surface thereof a sponge or other cleansing scraper which can be used in combination with the dispensed cleanser to clean the sink.

Figure 5:
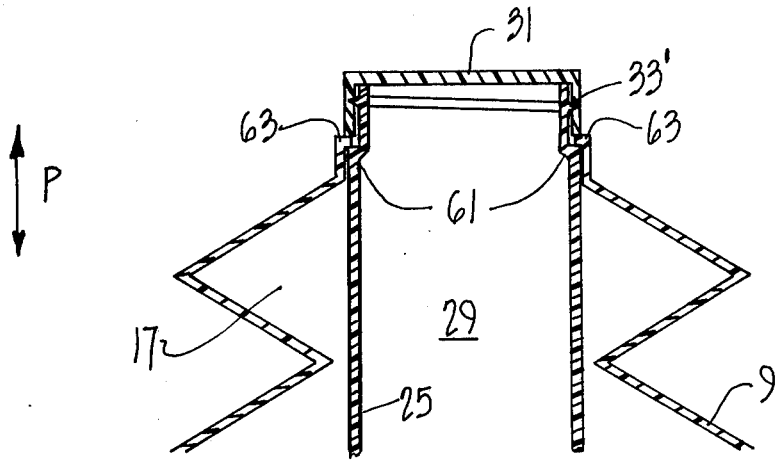
FIG. 5 is a partial plan side sectional view of the top of another embodiment of this invention.

FIG. 5 discloses another embodiment of how the plunger 25 may be connected to bellows 9 (i.e., retained within means 1). This is accomplished by providing plunger 25 with a circumferential rim 61 at a distance from its upper end. Bellows 9 are then provided with an inward flange 63 which rests on rim 61. When screw cap 31 is twisted on screw thread flange 33' the lower edge of cap 31 abuts flange 63, sandwiching it between itself and rim 61, thus securing the parts. If plunger 25 is a bottle, the upper surface of cap 31 may be provided with any convenient and conventional opening and closing orifice (not shown for convenience) to provide egress from chamber 29 of the cleaning material therewithin. Cap 31 need not be a screw cap and thread flange, 33' may merely be a snap-on thread, but in the preferred mode a screw cap and thread provide for a good, tight quality seal.

Once given the above disclosure, many other features, modifications, and improvements will become apparent to the skilled artisan. Such other features, modifications, and improvements are to be considered a part of this invention, the scope of which is to be determined by the following claims.

I claim:

1. A kitchen utensil for corralling refuse over a drain opening and forcing it through said opening, comprising a unitary outer hollow shell, a plunger extending longitudinally within said outer hollow shell and cap means for retaining the plunger in the shell, said shell including a lower hollow walled cavity of relatively large cross-sectional dimension and having a lowermost extremity for guiding refuse to said drain, the inner dimension of said shell at its lowermost extremity being larger than said drain opening thereby to define a refuse cavity, said shell further including an upper hollow walled cavity having an uppermost portion upon which said cap resides, said upper walled cavity being of smaller cross-sectional dimension than said lower cavity and having located in its walls means for collapsing and retracting said shell thereby to extend and retract said plunger, the upper and lower cavity being joined by an outwardly flaring wall, said plunger comprising a lowermost extremity compatible with, but of smaller dimension than said drain opening, an upper neck portion extending through and beyond said upper hollow walled cavity of said shell and being of lesser cross-sectional dimension than said upper cavity, and a lower bulb portion residing in said lower cavity of said shell and being of larger cross-sectional dimension than said upper cavity, said bulb portion being connected to said neck portion by an outwardly flaring wall extending adjacent to and below the outwardly flaring wall of said shell, said plunger being of sufficient length so that when the shell is fully retracted the lowermost extremity of said plunger is above the lowermost extremity of the shell and when the shell is collapsed, the lowermost extremity of said plunger extends beyond the lowermost extremity of the shell, said cap means being connected to that portion of said neck means which extends beyond said upper shell cavity and being of a larger cross-sectional dimension than said upper shell cavity, said cap means and said outwardly flaring walls co-operating to retain the plunger in the shell.

2. A kitchen utensil, according to claim 1, wherein the plunger is substantially hollow.

3. A kitchen utensil, according to claim 2, wherein said cap is twistably removable from the neck portion of the plunger.

4. A kitchen utensil, according to claim 1, which is substantially circular in cross-sectional shape.

5. A kitchen utensil for corralling refuse over a drain opening and forcing it through said opening, comprising a unitary outer hollow shell, a plunger hollow extending longitudinally within said outer hollow shell and means for retaining the plunger in said shell, said shell including a lower extremity comprised of a means for guiding refuse to said drain, the inner dimension of said shell at its lower extremity being larger than said drain opening thereby to define a refuse cavity, said shell further including an upper extremity and located intermediate the upper and lower extremities a shell portion comprising means for collapsing and retracting said shell longitudinally thereby to extend and retract said plunger, said plunger being of sufficient length so that when the shell is fully retracted the lowermost extremity of said plunger is above the lower extremity of the shell and when the shell is collapsed said plunger extends beyond the lowermost extremity of the shell, said plunger comprising a lower portion having a dimension compatible with but of smaller dimension than said drain opening, said lower portion being a hollow bulb defining a bulb chamber normally located in an upper portion of the refuse cavity and an upper longitudinally extending hollow neck portion defining a neck chamber located in the shell portion comprising said collapsing and retracting means, said bulb chamber being in communication with said neck chamber and wherein the means for retaining the plunger in said shell comprises a cap connected to the upper end of the neck portion of the plunger and adjacent the upper extremity of the shell, the cap being of a cross-section similar to, but of a larger dimension than the upper end of the neck portion of the plunger, and wherein said cap is rotatable about the plunger neck portion, the upper end of the plunger neck portion is sealed by a membrane having a dispensing hole extending therethrough, and the cap is provided with a hole extending therethrough which, upon rotation of the cap, may be brought into and out of alignment with the dispensing hole of said membrane, such that when said holes are aligned, there is formed a dispensing conduit in communication with the neck chamber, and such that when said holes are not aligned, the neck chamber is sealed.

6. A kitchen utensil for corralling refuse over a drain opening and forcing it through said opening, comprising a unitary outer hollow shell, a plunger hollow extending longitudinally within said outer hollow shell and means for retaining the plunger in said shell, said shell including a lower extremity comprised of a means for guiding refuse to said drain, the inner dimension of said shell at its lower extremity being larger than said drain opening thereby to define a refuse cavity, said shell further including an upper extremity and located intermediate the upper and lower extremities a shell portion comprising means for collapsing and retracting said shell longitudinally thereby to extend and retract said plunger, said plunger being of sufficient length so that when the shell is fully retracted the lowermost extremity of said plunger is above the lower extremity of the shell and when the shell is collapsed, said plunger extends beyond the lowermost extremity of the shell, said plunger comprising a lower portion having a dimension compatible with, but of smaller dimension than said drain opening, said lower portion being a hollow bulb defining a bulb chamber normally located in an upper portion of the refuse cavity and an upper longitudinally extending hollow neck portion defining a neck chamber located in the shell portion comprising said collapsing and retracting means, said bulb chamber being in communication with said neck chamber and wherein the means for retaining the plunger in said shell comprises a cap connected to the upper end of the neck portion of the plunger and adjacent the upper extremity of the shell, the cap being of a cross-section similar to, but of a larger dimension than the upper end of the neck portion of the plunger, and wherein the upper surface of the shell is provided with a flange, the neck portion of the plunger is provided with a circumferential rim upon which said flange resides and said cap when connected to the upper end of the neck portion of the plunger abuts said flange and secures it between said rim and said cap.

* * * * *